US011897826B2

(12) United States Patent
Lauck et al.

(10) Patent No.: US 11,897,826 B2
(45) Date of Patent: Feb. 13, 2024

(54) HYPERGOLIC TWO-COMPONENT SYSTEM FOR ROCKET ENGINES

(71) Applicant: Deutsches Zentrum fuer Luft- und Raumfahrt e.V., Cologne (DE)

(72) Inventors: Felix Lauck, Bad Friedrichshall (DE); Michele Negri, Moeckmuehl (DE); Dominic Freudenmann, Eberbach (DE)

(73) Assignee: Deutsches Zentrum fuer Luft- und Raumfahrt e.V., Cologne (DE)

( * ) Notice: Subject to any disclaimer, the term of this patent is extended or adjusted under 35 U.S.C. 154(b) by 592 days.

(21) Appl. No.: 16/946,729

(22) Filed: Jul. 2, 2020

(65) Prior Publication Data

US 2021/0017097 A1 Jan. 21, 2021
US 2021/0355046 A9 Nov. 18, 2021

(30) Foreign Application Priority Data

Jul. 19, 2019 (DE) ..... 10 2019 119 598.5

(51) Int. Cl.
*C06B 47/00* (2006.01)
*D03D 23/00* (2006.01)
*D03D 43/00* (2006.01)

(52) U.S. Cl.
CPC ..... *C06B 47/00* (2013.01)

(58) Field of Classification Search
CPC ..... C06B 47/00; D03D 23/00; D03D 43/00
USPC ..... 149/108.6, 109.2, 109.4, 109.6
See application file for complete search history.

(56) References Cited

U.S. PATENT DOCUMENTS 8,758,531 B1 * 6/2014 Schneider ..... C06D 5/08 149/109.2
9,090,519 B1 * 7/2015 Hawkins ..... C06B 47/00

OTHER PUBLICATIONS

Sun et al., "Hypergolicity evaluation and prediction of ionic liquids based on hypergolic reactive groups", Combustion and Flame, 205, (2019) 441-445, (Year: 2019).*
Sune et al. "Hypergolicty evaluation and prediction of ionic liquids based on hypergolic reactive groups," Combustion and Flame, 205, (2019), 441-445 (Year: 2019).*
Sun, et al; "Hypergolicity evaluation and prediction of ionic liquids based on hypergolic reactive groups"; Elsevier Journal; Combustion and Flame vol. 205; 2019; pp. 441-445.

* cited by examiner

*Primary Examiner* — James E McDonough
(74) *Attorney, Agent, or Firm* — Lipsitz & McAllister, LLC

(57) ABSTRACT

The present invention relates to a hypergolic two-component system for rocket engines, including a fuel and an oxidising agent provided in a manner separated from one another and can be reacted in a rocket engine by bringing them into contact with one another. The fuel is an ionic liquid comprising a thiocyanate anion and one or more cations. The cation or cations are selected from one or more imidazolium ions of the general formula I, triazolium ions of the general formula II or III, and/or tetrazolium ions of the general formula IV, where $R_1$ is a $C_1$- to $C_6$-alkyl radical or a $C_2$- to $C_6$-alkenyl radical, where $R_2$ is hydrogen or a $C_1$- to $C_6$-alkyl radical or a $C_2$- to $C_6$-alkenyl radical, and where $X_1$, $X_2$ and $X_3$ are each independently hydrogen, a $C_1$- to $C_6$-alkyl radical or a $C_2$- to $C_6$-alkenyl radical, and the oxidising agent comprises hydrogen peroxide.

20 Claims, No Drawings

HYPERGOLIC TWO-COMPONENT SYSTEM FOR ROCKET ENGINES

CROSS-REFERENCE TO RELATED APPLICATIONS

This application claims the priority of German application no. 10 2019 119 598.5 filed on Jul. 19, 2019, which is incorporated herein by reference in its entirety and for all purposes.

FIELD OF THE INVENTION

The present invention relates to a hypergolic two-component system for rocket engines, including a fuel and an oxidising agent that are provided in a manner separated from one another and can be reacted in a rocket engine by bringing them into contact with one another.

BACKGROUND OF THE INVENTION

In spacecraft, rocket propulsion devices are needed not only to achieve orbit but also for the purpose of controlling position and manoeuvring the spacecraft within the orbit. The orbital propulsion devices used for this are, like all rocket engines, based on the principle of reaction, and depending on the propellant used it is possible to differentiate between three types of orbital engine:

In cold gas thrusters, the propellant is a pressurised gas that is depressurised when a valve is opened and is ejected through a nozzle. Cold gas thrusters are thus based on a purely physical effect and have a very simple construction, but deliver only relatively little thrust energy. The specific impulse of these engines is typically in the range from 70 to 80 s.

Chemically powered rocket engines based on one-component systems utilise as the propellant a chemical compound that is capable of a reaction resulting in exothermic decomposition. The gaseous decomposition products of this reaction, which is normally implemented by way of a catalyst, are ejected through a nozzle and generate thrust. The specific impulse of such engines is typically in the range from 170 to 250 s. It is disadvantageous that a heating system is typically required in order to liquefy the propellants that are suitable for a one-component system, and to prevent freezing.

Hypergolic two-component systems are the most important in the case of orbital propulsion devices, in particular for relatively large spacecraft. These include, as the propellant system, a liquid fuel and a liquid oxidising agent that react exothermically with one another and release gaseous combustion products for the generation of thrust. The energy density of a two-component system of fuel and oxidising agent is generally higher than that of one-component systems, with the result that a specific impulse in the range of 270 to 320 s can be achieved. Moreover, there is no need for heating, since the usable components are in liquid form over a broad temperature range.

The two-component systems that are relevant for orbital engines are in principle hypergolic—that is to say that the chemical reaction between the fuel and the oxidising agent takes place spontaneously when they are brought into contact, with no need for an external ignition source. However, with some fuels or oxidising agents reactive or catalytic additives may have to be added to enable hypergolic ignition.

The hypergolic two-component systems known from the prior art comprise, as the fuel, hydrazine and/or derivatives thereof (such as monomethylhydrazine and unsymmetrical dimethylhydrazine) and, as the oxidising agent, dinitrogen tetroxide, where appropriate in a mixture with further nitrogen oxides. A significant disadvantage of these systems is the high toxicity of hydrazine and derivatives thereof. These are carcinogenic compounds, the handling of which requires the observance of strict safety measures. This results in high costs in manufacture, storage, transport and fuelling. Dinitrogen tetroxide is also classified as toxic.

It is thus the object of the present invention to provide a propellant system for rocket engines, in particular orbital propulsion devices, by means of which the above-mentioned disadvantages can be partly or completely obviated.

SUMMARY OF THE INVENTION

One aspect of the invention relates to a hypergolic two-component system for rocket engines, including a fuel and an oxidising agent that are provided in a manner separated from one another and can be reacted in a rocket engine by bringing them into contact with one another, wherein the fuel is an ionic liquid comprising a thiocyanate anion and one or more cations, wherein the cation or cations are selected from one or more imidazolium ions of the general formula I, triazolium ions of the general formula II or III, and/or tetrazolium ions of the general formula IV:

(I)

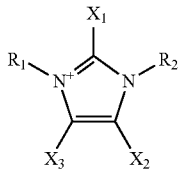

(II)

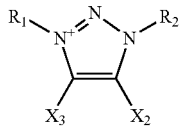

(III)

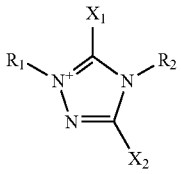

(IV)

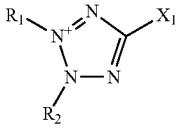

where $R_1$ is a $C_1$- to $C_6$-alkyl radical or a $C_2$- to $C_6$-alkenyl radical, where $R_2$ is hydrogen or a $C_1$- to $C_6$-alkyl radical or a $C_2$- to $C_6$-alkenyl radical, and where $X_1$, $X_2$ and $X_3$ are each independently hydrogen, a $C_1$- to $C_6$-alkyl radical or a $C_2$- to $C_6$-alkenyl radical; and wherein the oxidising agent comprises hydrogen peroxide.

Another aspect of the invention relates to a method for operating a rocket engine, in particular an orbital propulsion device, wherein the method comprises using the hypergolic two-component system of the invention as a propellant in the rocket engine.

By comparison with hydrazine and derivatives thereof, the fuels used in the two-component system according to the invention have markedly lower toxicity, with the result that potential damage to the environment can also be significantly reduced. However, a particular advantage results primarily from the fact that the fuels are ionic liquids which have practically no vapour pressure in ambient conditions. It is thus possible to handle these fuels in an open system without problems, which simplifies handling overall by comparison with hydrazine and reduces the associated costs.

Similar advantages are also produced according to the invention by the hydrogen peroxide used as the oxidising agent. This is not only substantially less toxic than dinitrogen tetroxide but also has a substantially lower vapour pressure (the boiling point of nitrogen tetroxide is only 21° C.). While open handling of nitrogen tetroxide is only possible with respiratory protection, hydrogen peroxide can be handled relatively unproblematically in both the pure form and in aqueous solution.

DETAILED DESCRIPTION OF THE INVENTION

Two-component systems for rocket engines that are based on hydrogen peroxide as the oxidising agent and ionic liquids as the fuel have already been described, for example in U.S. Pat. No. 8,758,531 B1. However, in the systems described there it is only possible to achieve hypergolic ignition behaviour by adding a further component, comprising a metallate anion of iron, cobalt, nickel or copper. Such supplementary additives make the system as a whole more complex and also have the disadvantage that in some circumstances insoluble metal salts may be precipitated during storage of the propellant.

Surprisingly, in combination with hydrogen peroxide as the oxidising agent, the fuels used according to the invention already ignite in hypergolic manner without the supplementary use of further additives, wherein in the so-called dripping test it is possible to achieve an ignition delay of less than 50 ms. Without espousing a particular theory, the assumption is made that this hypergolic behaviour is promoted in particular by the thiocyanate anion, which acts on the hydrogen peroxide as a reducing agent.

According to the invention, the cations of the ionic liquids that are used as the fuel are selected from five-membered heterocycles with two to four nitrogen atoms, which may have a broad range of substituents. Particularly preferred here are heterocycles with only two nitrogen atoms—that is to say the imidazolium ions according to general formula I. A number of substituted imidazolium thiocyanates are commercially available.

In general formulae I to IV, $R_2$ may also be hydrogen, while $R_1$ must be an alkyl or alkenyl radical. Preferably, $R_1$ and $R_2$ are each independently selected from a methyl group, an ethyl group, a propyl group, a butyl group, a vinyl group and an allyl group.

Cations of this kind for the ionic liquid in which $R_1$ is a methyl group or a vinyl group and/or in which $R_2$ is an ethyl group, a butyl group, a vinyl group or an allyl group are particularly preferred.

The substituents $X_1$, $X_2$ and $X_3$ on the carbon atoms of the heterocycle in general formulae I to IV are preferably each hydrogen.

In the context of the invention, the thiocyanate salts of the following cations are particularly preferred as the fuel:

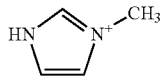

3-methylimidazolium (HMIM):

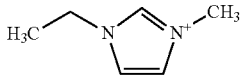

1-ethyl-3-methylimidazolium (EMIM):

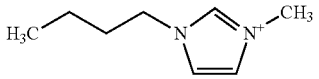

1-butyl-3-methylimidazolium (BMIM):

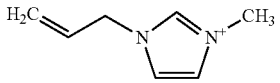

1-allyl-3-methylimidazolium (AMIM):

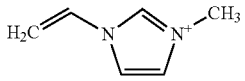

1-vinyl-3-methylimidazolium (VMIM):

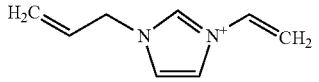

1-allyl-3-vinylimidazolium (AVIM):

At least the compounds EMIM thiocyanate and BMIM thiocyanate are currently commercially available.

The oxidising agent of the two-component system according to the invention comprises hydrogen peroxide, favourably in the form of an aqueous solution. Here, it is preferable if the oxidising agent has a concentration of hydrogen peroxide of 70 weight % or above, preferably 98 weight % or above. A concentration that is as high as possible is preferable, since it increases both the stability on storage and also the reactivity of the hydrogen peroxide with the fuel.

Favourably, besides hydrogen peroxide the oxidising agent contains only water and, optionally, one or more stabilisers. In the case of approximately 100% hydrogen peroxide, stabilisers can be dispensed with. Preferred stabilisers that are permitted for use in rocket propellants are selected from sodium nitrate, potassium stannate trihydrate and sodium stannate trihydrate.

As mentioned above, the two-component systems according to the invention have the substantial advantage that they display hypergolic ignition behaviour when the fuel is brought into contact with the oxidising agent, even in the absence of further additives. However, this does not exclude the possibility that, in the context of the invention, the fuel comprises one or more additives in order to shorten the ignition delay further when the components are brought into contact. The proportion of such additives in the fuel, where appropriate, is up to 30 weight %, further preferably up to 10 weight %.

The additives that are used according to the invention are preferably catalytic additives, which accelerate the reaction of the fuel and the oxidising agent. Preferably, the additives are selected from thiocyanates of transition metals, in particular thiocyanates of manganese, iron, cobalt, nickel and copper.

As an alternative or in addition, the fuel may also comprise a further ionic liquid in a proportion of up to 50 weight %, preferably up to 20 weight %, wherein the further ionic liquid contains metal ions. Compounds of this kind likewise act as catalytic additives.

The further ionic liquid preferably comprises as an anion a transition metal ion complex, preferably a halide, cyanide, nitrate, tetrahydroborate, azide, dicarbide or methyloxy complex of iron, cobalt, nickel or copper.

It is particularly favourable to add a further ionic liquid comprising a tetrachloroferrate anion, such as BMIM tetrachloroferrate.

The hypergolic propellant system according to the invention has the distinguishing feature of a short ignition delay when the fuel is brought into contact with the oxidising agent. Preferably, in the dripping test this ignition delay is less than 50 ms, further preferably less than 20 ms.

The present invention further relates to the use of the hypergolic two-component system according to the invention as a propellant in a rocket engine, in particular in an orbital propulsion device. However, the possible use is not restricted to orbital propulsion devices but in principle includes all the application areas of rocket engines.

The examples below serve to explain the invention in more detail without restricting it in any way.

EXAMPLES

1. Carrying Out the Dripping Test

In order to determine the ignition delay in different two-component systems according to the invention, 1 ml of the respective fuel is put into an open vessel. A drop having a volume of 50 μl, of a 96 weight % aqueous hydrogen peroxide solution, as the oxidising agent is dripped onto the fuel from a height of 80 mm. A camera is used to determine the ignition delay, which is defined as the time between the first contact between the fuel and the oxidising agent and the first appearance of a flame.

2. Results

As examples of different two-component systems according to the invention, the following fuels were tested in the dripping test:

- 1-butyl-3-methylimidazolium thiocyanate (BMIM SCN), both without any additives and with 6 weight % of copper thiocyanate or 30 weight % of BMIM tetrachloroferrate as the additive
- 1-ethyl-3-methylimidazolium thiocyanate (EMIM SCN), both without any additives and with 6 weight % of copper thiocyanate as the additive The measured ignition delays are shown in the table below. In each case, the figures represent the mean value with standard deviation, with the number of tests indicated in brackets:

| Ignition delay | No additive | +6% Cu SCN | +30% BMIM $FeCl_4$ |
|---|---|---|---|
| BMIM SCN | 45.1 ± 1.7 ms (7) | 18.5 ± 0.7 ms (6) | 20.5 ± 2.0 ms (5) |
| EMIM SCN | 28.8 ± 2.9 ms (21) | 12.0 ± 0.1 ms (5) | — |

The tests show that, with either BMIM SCN or EMIM SCN as the fuel, an ignition delay of significantly less than 50 ms is achieved without further additives, which in practice represents sufficiently fast ignition behaviour for a hypergolic two-component system.

Adding various catalytic additives can further reduce the ignition delay of the two-component system according to the invention, with the result that preferably values below 20 ms can be achieved.

What is claimed is:

1. A hypergolic two-component system for rocket engines, including a fuel and an oxidising agent that are provided in a manner separated from one another and can be reacted in a rocket engine by bringing them into contact with one another, wherein:

the fuel is an ionic liquid comprising a thiocyanate anion and one or more cations, wherein the cation or cations are selected from one or more imidazolium ions of the general formula I, triazolium ions of the general formula II or III, and/or tetrazolium ions of the general formula IV:

(I)

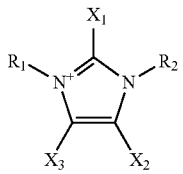

(II)

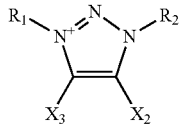

(III)

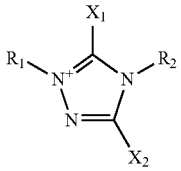

(IV)

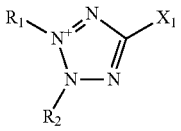

where $R_1$ is a $C_1$- to $C_6$-alkyl radical or a $C_2$- to $C_6$-alkenyl radical, where $R_2$ is hydrogen or a $C_1$- to $C_6$-alkyl radical or a $C_2$- to $C_6$-alkenyl radical, and where $X_1$, $X_2$ and $X_3$ are each independently hydrogen, a $C_1$- to $C_6$-alkyl radical or a $C_2$- to $C_6$-alkenyl radical; and wherein:

the oxidising agent comprises hydrogen peroxide, the fuel comprises one or more additives for the purpose of shortening the ignition delay when it is brought into contact with the oxidising agent, with a proportion of up to 30 weight %, and the additive or additives are catalytic additives that are selected from thiocyanates of transition metals.

2. The hypergolic two-component system according to claim 1, wherein the cation is an imidazolium ion of the general formula I.

3. The hypergolic two-component system according to claim 1, wherein $R_1$ and $R_2$ are each independently selected from a methyl group, an ethyl group, a propyl group, a butyl group, a vinyl group and an allyl group.

4. The hypergolic two-component system according to claim 1, wherein $R_1$ is a methyl group or a vinyl group.

5. The hypergolic two-component system according to claim 1, wherein $R_2$ is an ethyl group, a butyl group, a vinyl group or an allyl group.

6. The hypergolic two-component system according to claim 1, wherein $X_1$, $X_2$ and $X_3$ are each hydrogen.

7. The hypergolic two-component system according to claim 1, wherein the fuel comprises one or more of the following cations:

3-methylimidazolium (HMIM), 1-ethyl-3-methylimidazolium (EMIM), 1-butyl-3-methylimidazolium (BMIM), 1-allyl-3-methylimidazolium (AMIM), 1-vinyl-3-methylimidazolium (VMIM), 1-allyl-3-vinylimidazolium (AVIM).

8. The hypergolic two-component system according to claim 1, wherein the oxidising agent has a concentration of hydrogen peroxide of 70 weight % or above.

9. The hypergolic two-component system according to claim 1, wherein besides hydrogen peroxide the oxidising agent contains only water and, optionally, one or more stabilisers.

10. The hypergolic two-component system according to claim 1, wherein the fuel comprises a further ionic liquid in a proportion of up to 50 weight %, wherein the further ionic liquid contains metal ions.

11. The hypergolic two-component system according to claim 10, wherein the further ionic liquid comprises as an anion a transition metal ion complex.

12. The hypergolic two-component system according to claim 1, wherein, when the fuel is brought into contact with the oxidising agent in the dripping test, the system has an ignition delay of less than 50 ms.

13. A method for operating a rocket machine, comprising using the hypergolic two-component system according to claim 1 as a propellant in the rocket engine.

14. The method of claim 13, wherein the rocket engine is an orbital propulsion device.

15. The hypergolic two-component system according to claim 8, wherein the oxidising agent has a concentration of hydrogen peroxide of 98 weight % or above.

16. The hypergolic two-component system according to claim 1, wherein the fuel comprises the one or more additives with a proportion of up to 10 weight %.

17. The hypergolic two-component system according to claim 1, wherein the transition metals are selected from manganese, iron, cobalt, nickel and copper.

18. The hypergolic two-component system according to claim 10, wherein the fuel comprises the further ionic liquid in a proportion of up to 20 weight %.

19. The hypergolic two-component system according to claim 11, wherein the transition metal ion complex is a halide, cyanide, nitrate, tetahydroborate, azide, dicarbide or methyloxy complex of iron, cobalt, nickel or copper.

20. The hypergolic two-component system according to claim 12, wherein the system has an ignition delay of less than 20 ms.

* * * * *